United States Patent [19]

Young, Jr. et al.

[11] 4,217,826

[45] Aug. 19, 1980

[54] TIME DELAY FIRING DEVICE

[75] Inventors: Charles Young, Jr.; Gee-In Goo, both of Silver Spring, Md.

[73] Assignee: The United States of America as represented by the Secretary of the Navy, Washington, D.C.

[21] Appl. No.: 935,181

[22] Filed: Aug. 18, 1978

[51] Int. Cl.[3] ..... F42C 11/06; F42C 19/06

[52] U.S. Cl. ..... 102/200; 102/215; 102/276

[58] Field of Search ..... 102/215, 276, 200

[56] References Cited

U.S. PATENT DOCUMENTS

| | | | |
|---|---|---|---|
| 2,398,266 | 4/1946 | Whitesell, Jr. | 102/257 |
| 3,078,801 | 2/1963 | Rzewinski et al. | 102/276 |
| 3,444,815 | 5/1969 | Yeagley | 102/228 |
| 3,571,605 | 3/1971 | Dobson et al. | 102/215 |
| 3,614,930 | 10/1971 | Brackman et al. | 102/276 |
| 3,657,571 | 4/1972 | Martin et al. | 102/215 |
| 3,748,955 | 7/1973 | Gatermann et al. | 102/215 |
| 3,793,957 | 2/1974 | Stout et al. | 102/215 |
| 3,851,589 | 12/1974 | Meyer | 102/215 |
| 3,875,863 | 4/1975 | Bymoen et al. | 102/228 |

*Primary Examiner*—Charles T. Jordan

*Attorney, Agent, or Firm*—R. S. Sciascia; A. L. Branning; G. J. Perry

[57] ABSTRACT

A time delay firing device used for initiating explosives or pyrotechnics after a preset delay. The unique design allows the device to be used directly in combination with explosives or pyrotechnics or with a variety of accessories. It can be used in conjunction with a standard safety and arming device or with a special blasting adapter for initiating electric caps, or in conjunction with a training adapter for initiating standard pyrotechnics. When used in conjunction with a blasting or training adapter, the device can be refurbished and reset by the user in the field. Furthermore, a self test feature is provided. Time delays in eleven discrete settings from 15 minutes to 72 hours are achieved through the use of a highly stable oscillator coupled to a shift register counting circuit.

5 Claims, 17 Drawing Figures

EXPLOSIVE COMPONENT SECTION 12

ELECTRONIC MECHANISM SECTION 18

FIG. 1
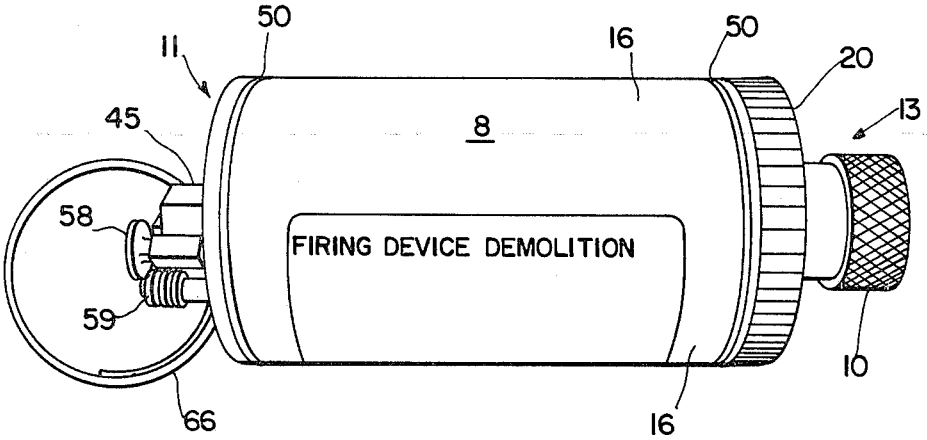
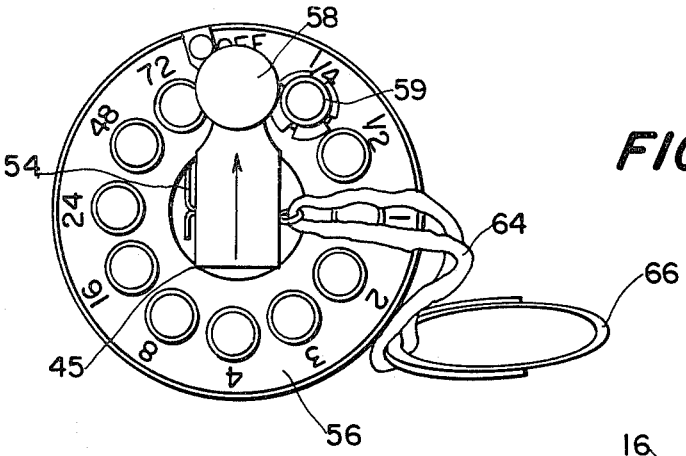
FIG. 2
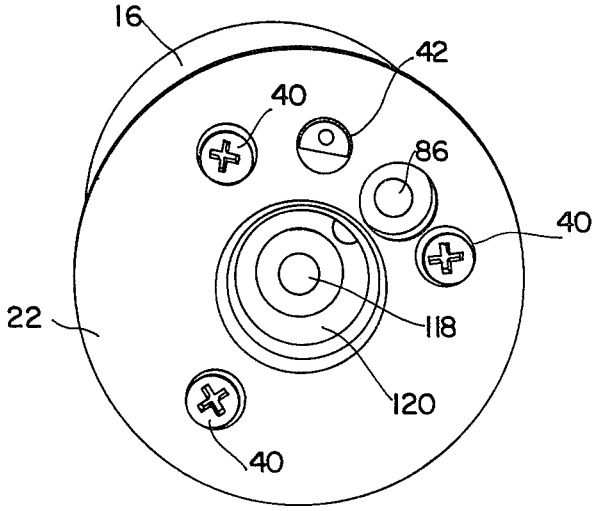
FIG. 3

TIME DELAY FIRING DEVICE

BACKGROUND OF THE INVENTION

This invention relates generally to demolition initiators. Specifically this invention relates to tactical devices used to initiate pyrotechnics and high explosives. More specifically, this invention relates to firing devices that permit the user to preselect a fixed time delay between arming and activation, allowing the user to escape the explosion area after arming the initiator.

Standard time delay firing devices used for initiating pyrotechnics and high explosives utilize a mechanical clock mechanism which releases a firing pin against a small charge (detonator) within the firing device. This detonator is located within an externally threaded snout designed to mate with a variety of booster devices.

The standard time delay firing device suffers from certain weaknesses rendering it unreliable and costly as a tactical weapon. Due to its mechanical nature, once fired in the field, it can not be reset and reused after initiating pyrotechnics without extensive refurbishing under laboratory or shop conditions. The detonator, located in the snout of a base coupling, blows forward to initiate the pyrotechnic device to which it is attached. In addition, it also blows backward into the timing device itself thereby damaging the timing mechanism. Repairs to this mechanical clock mechanism are prohibitively expensive. In addition, these mechanical time delay devices cannot be used to electrically fire remotely located demolition charges. They simply do not generate an electrical signal.

Furthermore, due to the gradual disappearance of clocksmiths and an industry-wide trend to the electronic measurement and display of time, the cost of building and maintaining mechanical mechanisms is increasing. In addition, mechanical devices are limited in the length of delay obtainable while maintaining high reliability of firing.

Another disadvantage of the mechanical devices in current use is their inability to be self-tested. The user must take them on blind faith in the field. There is no way to test the device to see if the timing mechanism is operative prior to use.

SUMMARY OF THE INVENTION

It is therefore an object of the present invention to provide a firing device that after a preselected time delay will initiate pyrotechnics or high explosives.

Another object of the present invention is to provide an electrically timed firing device.

A further object of the present invention is to provide a firing device in which the timing mechanism and detonator are physically separated so that the timing mechanism is not destroyed during use in training with pyrotechnics.

Another object of the present invention is to provide a firing device that generates an electrical signal after a preset delay.

Still another object of the present invention is to provide a firing device that can be easily refurbished and reset for repeated use.

Yet another object of the present invention is to provide a firing device in which the timing mechanism can be self-tested immediately prior to use.

A still further object of the present invention is to provide a versatile tactical firing device that can be used on land or underwater and under conditions of poor visibility.

Another object of the present invention is to provide a firing device capable of reliably measuring preset time delays accurately.

Yet another object of the present invention is to provide a firing device capable of selectable time delays of up to 72 hours.

These and other objects are achieved by providing a time delay firing device utilizing electronic timing means for initiating pyrotechnics or high explosives after a preselected time delay. The initiator includes three major sections: an explosive component section, a sleeve, and an electronic mechanism section, shown generally in FIG. 4. The electronic mechanism section slides into the sleeve and the explosive component section screw couples to one end plate of the electronic mechanism within the sleeve, producing a compact unit weighing approximately 24 ounces in air that can be easily carried and manipulated by the user.

The explosive component section includes a base coupling for channeling the blast from an electric detonator and contact assembly out of the firing device and into an attached explosive or pyrotechnic. This base coupling which contains the electric detonator threads into a bottom end plate which is in turn bolted to the electronic mechanism section. A standard coupling snout protrudes from the base coupling for easy attachment to a pyrotechnic or explosive initiating device. When the electric detonator explodes, it ruptures the coupling snout end which either initiates a safety and arming device and explosives or drives a firing pin which initiates a pyrotechnic device. A protective cap screws over the snout of the base coupling to provide for safety in shipping and handling.

The sleeve is a cylinder which encloses and protects the electronic mechanism and fits over bottom and top end plates. O-rings around the end plates form waterproof seals allowing the device to be used under water. Electromagnetic radiation rings (EMR) at both top and bottom end plates shield the electronics of the device from radiation.

The electronic mechanism section includes an oscillator and shift register counting circuit. A single-pole, twelve position rotary switch allows the user to select various shift register circuit configurations so that various time delays can be selected. This rotary switch is operated by a shaft passing through the switch and through the top end plate and a dial face marked with indicia representing the various switch contact positions.

Time selections are made by a setting knob attached to the end of the shaft. The time setting can be locked in place by pressing down a knob retainer to mate with one of various holes provided in the dial face. A knob stop is provided for use under conditions of poor visibility. A self-test feature is provided so that the user can test the function of the self-contained battery and timing circuit. When operating in the self-test mode, timing occurs much more rapidly than real time so that the user can perform such a test in the field immediately prior to use. A safety interlock prevents initiation under self-test timing when the firing device is attached to a base coupling and electric detonator.

Arming of the device is achieved by pulling an arming pin passing through the shaft and knob. The pulling of this pin allows the shaft, which is strongly spring biased, to snap inward. A cam on the shaft operates an ON-OFF switch in the electronic mechanism section.

The use of a special reset tool allows the shaft to be pushed back into an unarmed position when the electronic mechanism is removed from the sleeve.

BRIEF DESCRIPTION OF THE DRAWINGS

Many of the attendant advantages of the present invention will be readily apparent as the invention becomes better understood by reference to the following detailed description with the appended claims, when considered in conjunction with the accompanying drawings, wherein:

FIG. 1 is a side view of the time delay firing device according to the present invention.

FIG. 2 is an end view of the time delay firing device showing the time delay set switch.

FIG. 3 is an end view of the time delay firing device showing the bottom end plate.

FIGS. *9a*, *9b*, and *9c* are top and side views of the setting knob assembly of the time delay firing device.

Figure 10:
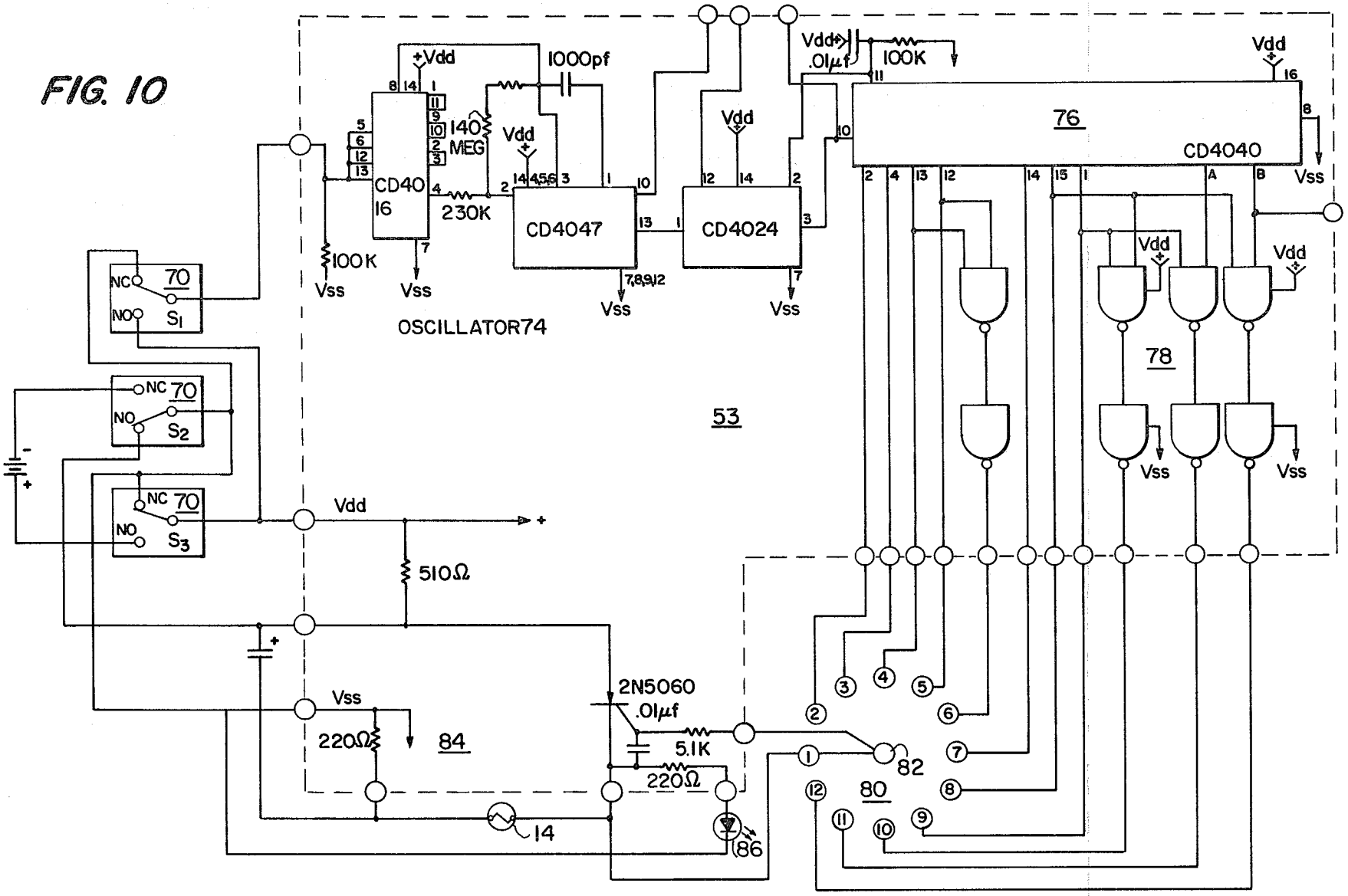

FIG. 10 is a schematic diagram of the firing circuit of the time delay firing device.

Figure 11:
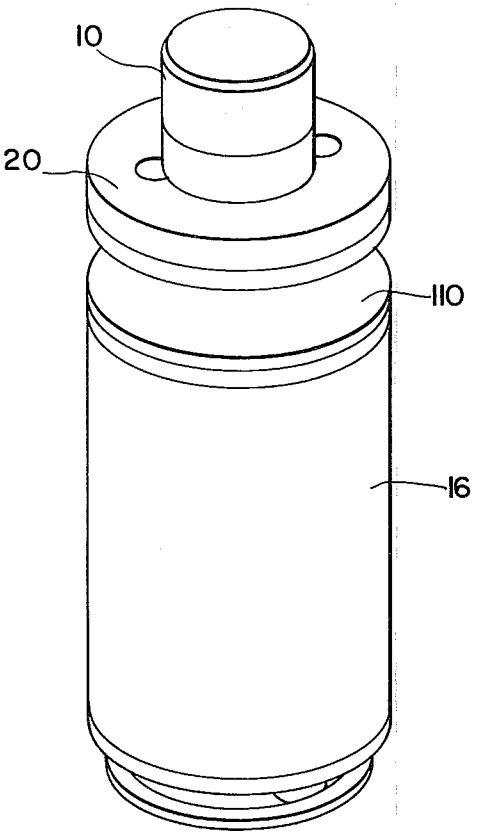

FIG. 11 is a pictorial view of the time delay firing device including the training adapter.

Figure 12:
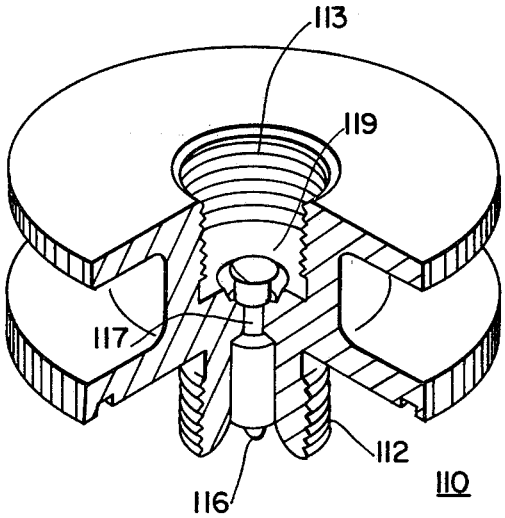

FIG. 12 is a cutaway perspective view of the training adapter insertable between the bottom end plate and base coupling.

Figure 13:
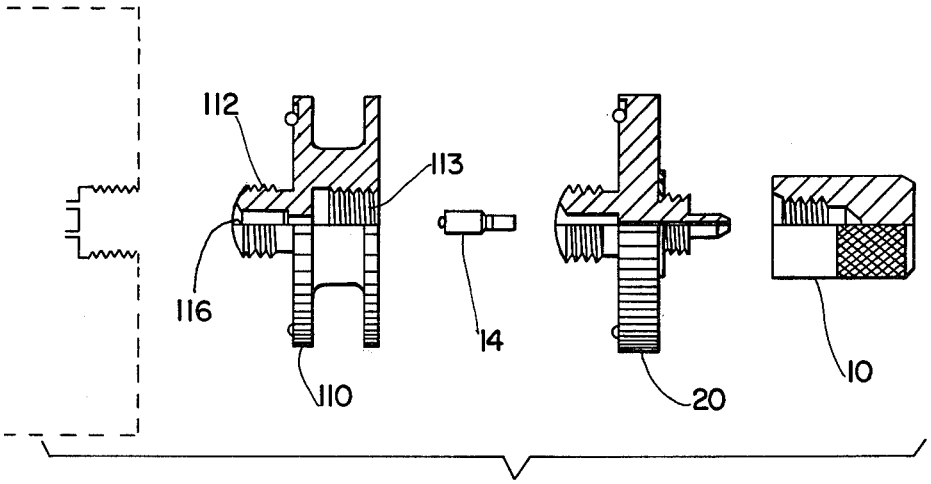

FIG. 13 is an exploded partially cutaway side view of the explosive components section of the time delay firing device including the training adapter interposed between the bottom end plate and the base coupling.

Figure 14:
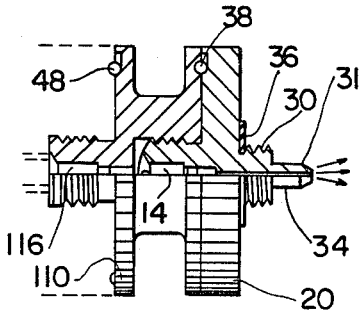

FIG. 14 is a cutaway view of the training adapter attached to the base coupling.

Figure 15:
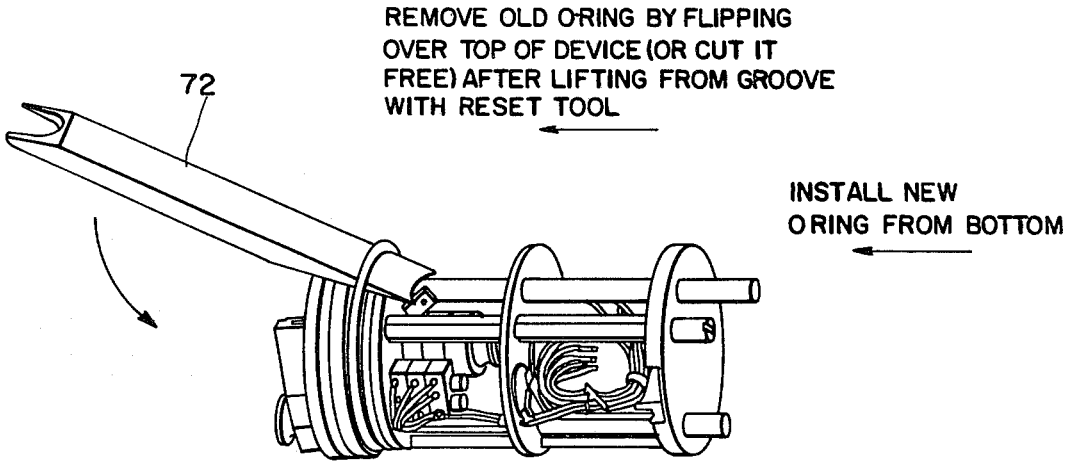

FIG. 15 is a pictorial view of the time delay firing device with the sleeve removed illustrating the use of the special tool for the removal of O-rings.

DESCRIPTION OF THE PREFERRED EMBODIMENT

GENERAL PHYSICAL CHARACTERISTICS

The time delay firing device 8 according to the present invention and having a dial end 11 and a base-end 13 is shown in side view in FIG. 1. A sleeve 16 covers electronics mechanism section 18 (visible in FIG. 4). Electromagnetic radiation rings (EMR rings) 50 shield the device from radiation. On the left side of the device, a setting knob 45 with a knob retainer 58 and knob stop 59 are visible. The removal of an arming pin (cotter) 54 (not visible) coupled via a cord 64 (not visible) to a pull ring 66 arms the device after a time delay has been selected by the user.

A base coupling 20 containing a detonator 14 (not shown) fires a detonation in response to a firing signal generated by electronics mechanism section 18. A protective cap 10 shields and protects the snout 31 (not shown) of base coupling 20. The device measures approximately $2\frac{1}{4}$ inches in diameter and $6\frac{1}{4}$ inches in length, and weighs approximately 24 ounces in air and 12 ounces in seawater.

Referring now to FIG. 2 the dial end 11 of the time delay firing device 8 is more clearly depicted. A dial face 56 with twelve holes cut therein provide setting knob positions for an OFF position and eleven different delay firing times selectable as follows: OFF, $\frac{1}{4}$ hr, $\frac{1}{2}$ hr, 1 hr, 2 hrs, 3 hrs, 4 hrs., 8 hrs., 16 hrs., 24 hrs., 48 hrs., and 72 hrs. Cord 64 coupling arming pin 54 to pull ring 66 is clearly visible.

The base end of firing device 8 is more clearly shown in FIG. 3. In this figure, base coupling 20 is removed to reveal a bottom end plate 22 having several bores therethrough. Three bottom end plate screws 40 secure bottom end plate 22 to the electronic mechanism section 18. Inner and outer terminals 118 and 120 respectively carry the electrical firing signal from electronics mechanism section 18 to base coupling 20 or to an ordnance device (such as a blasting adapter) to which the firing device 8 may be coupled directly (without base coupling 20). Also shown in FIG. 3 is a stop rod 42 which provides interlock safety and a test lamp 86 allowing the user to field test the device for timing accuracy.

Figure 4:
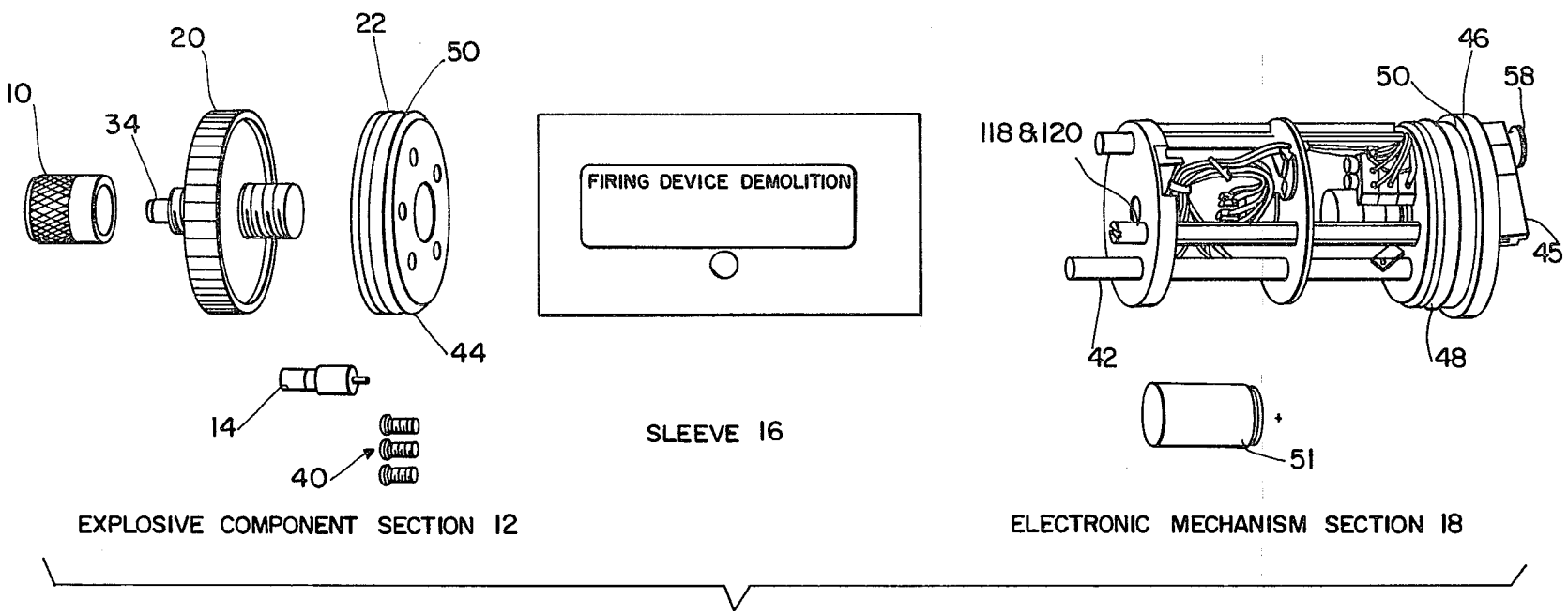
FIG. 4 is an exploded view of the time delay firing device detailing its three main sections.

Referring now to FIG. 4, which is an exploded view, the firing device includes three main sections:

1. An explosive components section 12 containing an electric detonator 14 which initiates the explosive train;
2. a sleeve 16 which contains and protects the device's electronic mechanism section 18; and
3. an electronic mechanism section 18, which determines the preselected delay time set by the user and furnishes a firing signal to detonator 14 or to self-test lamp 86 (not shown) mounted in electronic mechanism section 18 and aligned such that it is visible through a hole in a bottom end plate 22 of the device.

EXPLOSIVE COMPONENTS SECTION (12)

Figure 5:
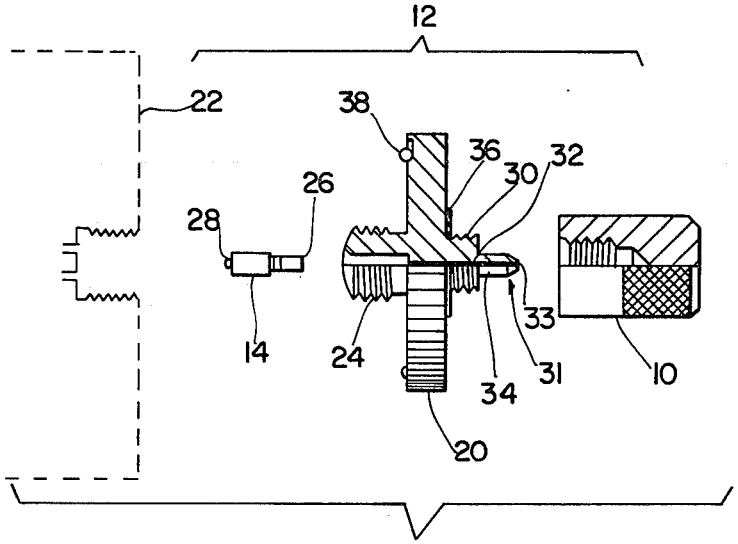
FIG. 5 is an exploded partially cutaway side view of the explosive components section of the time delay firing device.
Figure 6:
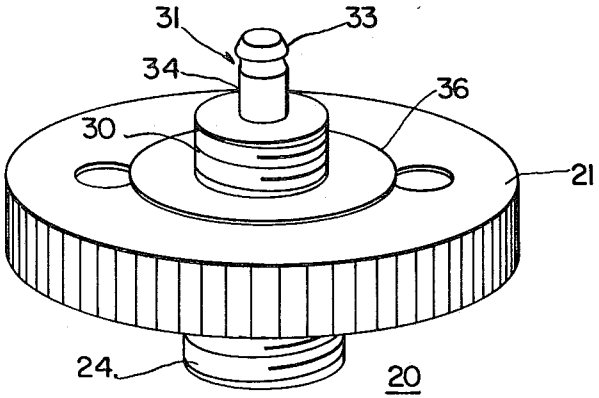
FIG. 6 is a pictorial view of the base coupling of the time delay firing device.

Referring now to FIG. 5, which is a cutaway and exploded view of explosive component section 12, base coupling 20 contains electric detonator 14 and threads into bottom end plate 22 of the firing device. Base coupling 20, shown pictorially in FIG. 6, is essentially a disc 21 approximately $2\frac{1}{4}$ inches in diameter and having a partially hollowed, externally threaded bushing 24 on one face, the threads of which mate with internal threads of bottom end plate 22. Electric detonator 14 having a flat side 26 and a rounded side 28 inserts into this hollowed bushing with its flat side toward base coupling 20. An externally threaded coupling bushing 30 terminating in a snout 31 is attached to the opposite side of disc 21 and couples the demolition initiator to the ordnance in conjunction with which it is being utilized or mates with protective cap 10 when the device is not in use. A narrow hole 32 passes through base coupling 20 from the hollowed region of bushing 24 through disc 21, bushing 30 and snout 31 to provide a path for the explosive charge. Hole 32 is terminated by a webbing 33 at its snout end to provide a waterproof seal. A thin rubber sleeve 34 covers snout 31 of bushing 30 to provide a watertight seal when a non-electric blasting cap is crimped onto snout 31. Waterproofing is also aided by a rubber gasket 36 at the junction of disc 21 with bushing 30 and by the action of an O-ring 38 at the bottom end plate side of disc 21.

Figure 7:
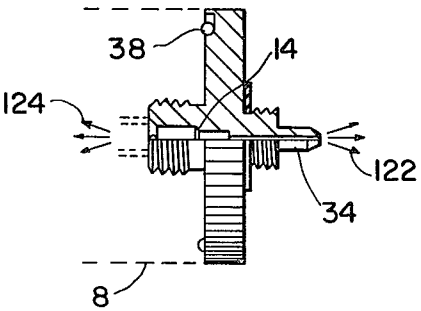
FIG. 7 is a partially cutaway side view of the base coupling of the time delay firing device.

Referring now to FIG. 7, which is a cutaway view of base coupling 20, when detonator 14 fires, the explosion blows through bushing 24, disc 21, bushing 30, snout 31 and webbing 33 as indicated by arrows 122. A back blast, indicated by arrows 124, also occurs. An O-ring 44, shown in FIG. 4, around the periphery of bottom end plate 22 helps to provide a waterproof seal. Snout 31 and bushing 30 are machined to mate with a variety of ordnance devices thereby allowing general use of the demolition initiator. As will be further explained, during self-test, base coupling 20 is removed thereby allowing stop rod 42 to extend freely from electronic mechanism section 18. Stop rod 42 is essentially a safety device coupled to setting knob 45 in such a manner that the raising of setting knob 45 causes stop rod 42 to protrude from the bottom of the device. Conversely, when stop rod 42 is prevented from such protrusion (when base coupling 20 is in place), setting knob 45 cannot be raised to engage the self test mode of operation. In operational use with base coupling 20 in place, setting knob 45 cannot be placed in a raised position as shown in FIG. 9c. It cannot be raised more than $\frac{1}{4}$ inch and the self-test position is locked out.

The function of base coupling 20 is to channel an explosive blast from electric detonator 14 out of snout 31 of the base coupling to an attached ordnance. When detonator 14 explodes it ruptures webbing 33 at the end of the snout 31 and the explosion is channeled out of snout 31 and into the attached ordnance device. In the alternative, the explosion can be used to drive a firing pin slipped over the end of the snout 31 in order to initiate a standard pyrotechnic device requiring this type of trigger.

SLEEVE (16)

The sleeve 16 of the time delay firing device is a metal cylinder which encloses and protects the device's electronic mechanism. Sleeve 16 is approximately $2\frac{1}{4}$ inches in diameter, $3\frac{3}{4}$ inches in length and fits over both bottom end plate 22 and a top end plate 46. An O-ring 48 around the periphery of top end plate 46 along with O-ring 44 around bottom end plate 22 form waterproof seals of the sleeve 16. Electromagnetic radiation rings 50 at each end of sleeve 16 protect the electronics from exposure to electromagnetic radiation.

ELECTRONIC MECHANISM SECTION (18)

Figure 8:
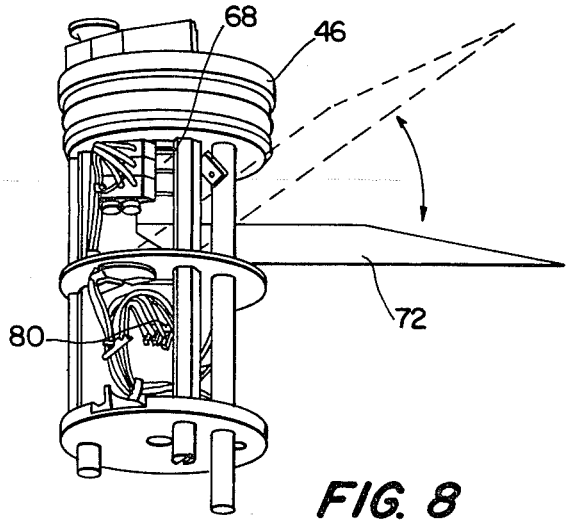
FIG. 8 is a pictorial view of the electronic mechanism section of the time delay firing device and also showing the special tool being used to reset the cam.
Figure 9A:
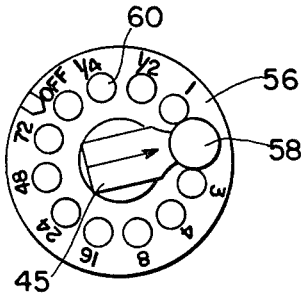
Figure 9B:
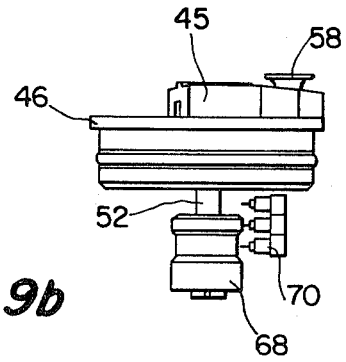
Figure 9C:
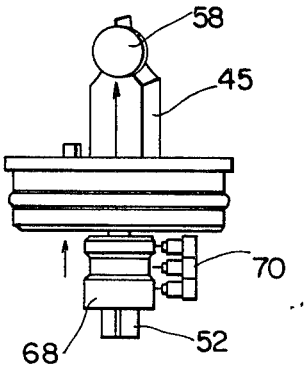

FIG. 8 is a more detailed pictorial view of electronics mechanism section 18 and FIGS. 9*a*, 9*b* and 9*c* are top and side views of the upper portion of electronics mechanism section 18. Referring now to those figures, the major components of electronics mechanism section 18 are an electronic clock circuit 53 (schematically detailed in FIG. 10), setting knob 45, rotary switch 80, microswitches 70, cam 68, shaft 52, top end plate 46, and dial face 56. Top end plate 46 has a hole bored through its center which hole has sufficient diameter to accommodate shaft 52. Shaft 52 passes through this hole and couples to setting knob 45 in such a manner that when the setting knob is raised away from top end plate 46 and dial face 56, shaft 52 moves through the hole toward the top end plate and dial face. Cam 68, coupled to shaft 52, likewise moves toward top end plate 46 and dial face 56, is positioned in FIG. 9*c* such that it activates microswitches 70, causing the firing device to operate in the self-test mode. When setting knob 45 is returned to its normal position in FIG. 9*b* (not extended away from top end plate 46 and dial face 56) shaft 52 moves through the hole toward bottom end plate 22. Shaft 52 is attached to setting knob 45 by an arming pin (cotter) 54 passing through the setting knob and shaft.

The other end of shaft 52 is coupled to the rotor of a twelve position single pole rotary switch 80 shown in FIG. 8 which is a perspective view of electronics mechanism section 18. Switch 80 is electrically part of electronic clock circuit 53 (See FIG. 10) and is used to select the various time delays available to the user. Attached flush to top end plate 46 and below setting knob 45 is dial face 56 which is marked: OFF, $\frac{1}{4}$, $\frac{1}{2}$, 1, 2, 3, 4, 8, 16, 24, 48, and 72. These markings refer to the possible time delays, measured in hours, that are available to the user. The OFF setting provides a safe position. Holes 60 in dial face 56 at each of the 12 marked positions engage a knob retainer 58, passing through setting knob 45 to lock the knob into position once a particular time selection has been made by the user.

Time selections are made when setting knob 45 is in the down (horizontal) position and knob retainer 58 is disengaged. Knob retainer 58 is pressed in to engage one of the holes 60 after it has been rotated to the desired time setting, thereby locking setting knob 45 in place. A knob stop 59 is provided for use under conditions of poor visibility. Knob stop 59 is a peg which is inserted in the next higher time setting hole 60 than that desired to be used. This allows the user to find the correct setting by touch alone. The user simply rotates setting knob 45 until it moves no further and then locks the knob in place using knob retainer 58. The knob stop prevents setting knob 45 from going past the time setting desired.

For ease of use, arming pin 54 is connected via a cord 64 to a pull ring 66 (shown in FIG. 2). After the appropriate time has been selected and locked into place by the user, and after the device is properly deployed, the user yanks pull ring 66 thereby separating arming pin 54 from setting knob 45. Shaft 52, which is spring biased, snaps inward. A cam 68, mounted on shaft 52, activates microswitches 70. Microswitches 70 are a group of three (3) separate switches engagable by cam 68. Different combinations of these switches are activated when:

1. setting knob 45 is raised for rotation,
2. setting knob 45 is locked in place, and
3. setting knob 45 is locked in place and arming pin 54 has been pulled, allowing shaft 52 to spring inwardly. At this point the user may remove knob 45, retainer 58, and stop 59 to prevent unauthorized disclosure of the time setting.

SPECIAL TOOL

Referring again to FIG. 8, which is a diagram of electronic mechanism section 18 of the device, a special reset tool 72 is shown being used to reset shaft 52 and cams 68 after use of the time delay firing device. Tool 72 is made of plastic and has two separate and distinct uses; its thin highly tapered end is used to remove rubber O-rings, without damage to their grooves, while its thick end is used to reset the firing device after use with a training adapter or blasting adapter, as is further discussed below. Tool 72 being used to remove an O-ring is illustrated in FIG. 15.

TIMING MECHANISM

The electronic timing circuit is detailed schematically in FIG. 10. The heart of the timer is a COS/MOS oscillator 74 which provides a stable time base and digital pulses, and a shift register counter 76. Gates 78, coupled to the various shift register outputs are electrically selected by a rotary switch 80 coupled to shaft 52 for rotation by setting knob 45. The pole 82 of rotary switch 80 is coupled to a firing circuit 84. Gates 78 select the appropriate stages of counting corresponding to the time delay selected by the user. Shift register 76 acts as a binary counter, counting the oscillations of oscillator 74. Oscillator 74 is extremely stable and of known frequency and therefore the number of counts in register 76 corresponds to a specific amount of elapsed time following initiation of the firing cycle. Pulse duration of oscillator 74 is selected such that counter 76 outputs are binary multiples of the time base. For the component values selected and shown on FIG. 10, the time base is ¼ hr. and all other possible time delay settings are binary multiples of ¼ hr.

At the expiration of the selected time interval, a trigger pulse appears on pole 82 of rotary switch 80 and is thereby coupled to firing circuit 84. This pulse triggers firing circuit 84 to discharge energy stored within it through detonator and contact assembly 14 thereby initiating an explosive train that is ultimately channeled through coupling snout 31 to the explosive or pyrotechnic being fired.

USE AND FIRING

Referring now to FIG. 11, the time delay firing device according to the present invention is extremely versatile and can be coupled to and used in conjunction with a number of different types of devices. It can be attached directly to a pyrotechnic device to be fired after a preset delay, in combination with a safety and arming device, with a training adapter 110 or with a blasting adapter (used in place of base coupling 20 to electrically fire a blasting cap at a remote location not shown in figures).

Used with a training adapter interposed between the body of the device and base coupling 20, only the base coupling and detonator 14 are expended when pyrotechnics are fired. For firing explosives, the firing device is coupled to an electric blasting cap, a safety and arming device, or a blasting adapter. The device itself is damaged by the back blast when coupled directly to a blasting cap or safety and arming device. However, the firing device is not damaged when used with a blasting adapter because detonator 14 is not included in the explosive train. In this case, the blasting adapter boosts the electrical output of the firing device sufficiently to remotely fire a blasting cap via a hard wire. The electrical output of the firing device is sufficient to fire a detonator but not a blasting cap. The firing device according to the present invention provides this required versatility.

In use, protective cap 10 is removed from base coupling 20, revealing coupling snout 31 and coupling bushing 30 which is externally threaded. Bushing 30 can then be mated with either a safety and arming device (not shown) or coupling snout 31 can be mated directly with the ordnance to be fired (not shown).

Knob retainer 58 is pried up with the fingers and knob 45 is rotated to the desired time delay setting according to dial face 56. When knob 45 is in position, knob retainer 58 is above the appropriate hole 60 in dial face 56. Knob retainer 58 should be pushed securely into one of the holes 60 to insure retention of the desired time setting while pulling the arming pull ring.

The process of count down of the time delay selected and ultimate firing of detonator and contact assembly 14 by firing circuit 84 is started when arming pin 54 is yanked from setting knob 45. When pin 54 is extracted, shaft 52, which is spring biased, snaps toward bottom end plate 22, carrying cam 68 with it, thereby triggering the proper switch combination in microswitches 70 to initiate the firing cycle.

When detonator 14 fires, its explosion is channeled through the center bore of base coupling 20 and out of its coupling snout 31 to initiate an explosive or pyrotechnic device.

TRAINING ADAPTER

Referring now to FIG. 12, which is a cutaway view of the training adapter, the firing device 8 is capable of being used in conjunction with a training adapter 110. The purpose for training adapter 110 is to physically separate the explosive blast from detonator 14 from electronics mechanism section 18 of the firing device. The use of training adapter 110 allows firing device 8 to be used during training to fire pyrotechnics or with a blasting adapter to remotely fire high explosives and then be reset and reused repeatedly. Adapter 110 is configured as shown in FIGS. 12, 13, and 14. A threaded bushing 112 on its firing device end allows training adapter 110 to be screwed into the firing device 8 in place of base coupling 20. Base coupling 20 is in turn screwed into a threaded bore 113 on the base coupling end of training adapter 110 with detonator 14 inserted into base coupling 20 as before. A button terminal 116 within threaded bushing 112 provides electrical contact with the firing device. Button terminal 116 includes a narrow portion 117 fitting snugly into a narrow bore which is the only path within training adapter 110 from threaded bushing 112 to threaded bore 113. Epoxy 119 around terminal 116 aids in isolating the back blast within threaded bore 113. As stated, the purpose of training adapter 110 is to prevent the firing device from being destroyed during routine pyrotechnic training from backblast of the detonator 14. By the use of training adapter 110, the device itself is mechanically separated from the explosion of detonator 14. Real life training can be conducted without damaging valuable devices.

Referring now to FIG. 14, which is a cutaway view of training adapter 110 coupled to base coupling 20, protection to electronic mechanism section 18 from the backblast of detonator 14 is provided through mechanical isolation. Terminal 116 provides transfer of the electrical firing signal from electronics mechanism section 18 to detonator 14 within base coupling 20, yet the backblast from the detonator cannot penetrate the terminal. O-rings 38 and 48 help to provide a watertight seal when training adapter 110 is being used.

REFURBISHMENT AFTER TRAINING

After the firing device has been fired using training adapter 110 between base coupling 20 and bottom end plate 22, to prevent damage to the device, it can be refurbished for another use.

In operation, once a particular time delay has been selected by the user, pull ring 66 is yanked away from the demolition initiator. Shaft 52 is spring biased so that upon removal of arming pin 54, coupled to pull ring 66 via cord 64, the shaft is allowed to spring toward bottom end plate 22. In this manner cam 68 secured to shaft 52 operates microswitches 70 causing the timing cycle to begin. The unique mechanical design of the firing device allows the user to reset the electronic clock and repin shaft 52 to setting knob 45 for reuse. By refurbishment, the position of shaft 52 and cam 68 in relation to microswitches 70 is restored to its original unarmed position. A new arming pin 54 is then inserted through setting knob 45 and shaft 52 to maintain this unarmed shaft position until the user wishes to again operate the demolition initiator.

Refurbishment of the firing device is accomplished by first removing training adapter 110 and base coupling 20 (as a single unit) from the rest of the firing device. Next, the three screws 40 securing bottom end plate 22 are removed. A replacement base coupling unit 20, not having a detonation and contact assembly 14 inserted therein, is then screwed onto bottom end plate 22 and pulled outwardly. This pulling removes bottom end plate 22 from sleeve 16. After base coupling 20 and bottom end plate 22 are fully removed from the device, the base coupling can be unscrewed from the bottom end plate 22. Now sleeve 16 can be removed from its position surrounding the electronics mechanism section 18.

Referring again to FIG. 8, the large end of tool 72 is inserted under cam 68. Using tool 72 as a wedge, cam 68 is pushed upward while the tool is slid forward. This pushing forces shaft 52 back to its unarmed position and locks it there. While tool 72 is in place holding cam 68 and shaft 52 in their respective unarmed positions, setting knob 45 is installed over that part of shaft 52 protruding from dial face 56. A biased face in a slot on setting knob 45 mates with a biased force on shaft 52 to insure correct orientation of the setting knob. After knob 45 is in place a new arming pin 54 can be installed through the knob and shaft 52 to hold the shaft and maintain it in an unarmed position. Cord 64 and pull ring 66 can then be tied to a new arming pin 54. After setting knob 45 is installed, it should then be turned to the "OFF" position. Tool 72 can then be safely removed as knob 45 is secured by arming pin 54. The prongs of pin 54 should be spread to insure that it is not inadvertently withdrawn. If necessary, battery 51 (shown in FIG. 4) can be replaced as necessary to insure reliability. O-rings 44 and 48 can be replaced to insure a continued watertight seal as shown in FIG. 15. Sleeve 16 can now be slipped back into position and bottom end plate 22 and base coupling 20 reinstalled. A training adapter can be reused about 9 times. After each use it is cleaned using wire brushes and then electrically tested using an ohmmeter. Base coupling 20 and detonator 14 are the only parts destroyed. Typically a refurbishment kit is provided containing one training adapter 110 and ten base couplings 20. After each use, training adapter 110 is cleaned and base coupling 20 is thrown away and a new one selected from the kit.

SELF-TEST FEATURE

This time delay firing device is equipped with a self-test feature. This self-test mode of operation is designed to allow the user to verify that the full range of time delay settings is within acceptable limits. Self-test is accomplished by rotating setting knob 45 to a specific time selection and then raising it (FIG. 9*c*). The base coupling 20 must have been removed or the knob 45 cannot be raised, being blocked by the rod stop 42.

Referring again to FIGS. 9*b* and 9*c*, note that there are three microswitches 70 which are switched on in various combinations by the action of cam 68. When knob 45 is in its lowered position, cam 68 appears as shown in the lower left drawing of FIG. 9*b*, with only the center switch of microswitches 70 activated. However, when knob 45 is raised, cam 68 moves upward and the top and bottom switches 70 are activated and the center switch opens 70. This knob- raised position allows the oscillations from oscillator 74 to be counted 600 times "faster" than normal. The activation of a test lamp 86, shown schematically in FIG. 10 indicates that "firing" has occurred. Test lamp 86 can be viewed through a hole provided in bottom end plate 22 for that purpose, referring to FIG. 3. Using electrical values as shown on FIG. 10, self-test firing will occur at times shown in the following table:

TEST INTERVALS

| Dial Setting | Nominal Test Time |
|---|---|
| OFF | Safe. No light |
| ¼ | 1.5 sec. |
| ½ | 3 sec. |
| 1 | 6 sec. |
| 2 | 12 sec. |
| 3 | 18 sec. |
| 4 | 24 sec. |
| 8 | 48 sec. |
| 16 | 1 min. 36 sec. |
| 24 | 2 min. 24 sec. |
| 48 | 4 min. 48 sec. |
| 72 | 7 min. 12 sec. |

By utilizing this self-test feature, the user can be confident that the timing mechanism will function as desired. A thorough test should include a 15 min. time test in addition to the "quick time" provided by self-test. Lamp 86 is wired such that it lights in normal use as well as in self-test.

Therefore, it is apparent that there has been provided a demolition initiator using an electronic clock mechanism to provide selectable time delays up to 72 hours. The unique mechanical design allows a training adapter to be interposed between the electronic mechanism and the base coupling containing a detonator so that detonator 14 will not destroy the electronic mechanism section of the device. This non-destructive isolation, in conjunction with the unique shaft/cam and microswitch arrangement allow the timer to be reset and the device used repeatedly. The use of O-rings and a rubber sleeve over snout 31 of the base coupling 20 and rubber washers on the base coupling insure a watertight seal so that the initiator can function under water. The use of a COS/MOS oscillator circuit provides a high degree of timing accuracy even over long time delay periods.

Obviously, other embodiments and modifications of the present invention will readily come to those of ordinary skill in the art having the benefit of the teachings presented in the foregoing description and the drawings. It is, therefore, to be understood that this invention is not to be limited thereto and that said modifications and embodiments are intended to be included within the scope of the appended claims.

What is claimed and desired to be secured by Letters Patent of the United States is:

1. A firing device for initiating ordnance elements and systems after a preselected time delay comprising:

electronic oscillator means of known predetermined frequency for generating a series of electrical pulses;

means coupled to said electronic oscillator means for counting said predetermined number of pulses;

means coupled to said counting means for presetting a predetermined number of such pulses corresponding to a predetermined time delay;

means coupled and responsive to said counting means for generating an electrical firing signal after said predetermined number of pulses have been counted;

a bottom end plate containing electrical terminals through which said firing signal is made available for coupling to ordnance elements and system to initiate said ordnance elements and systems after a preselected and preset time delay;

detachable base coupling means, coupled to said electrical firing signal generating means, for causing a detonation explosion in response to said electrical firing signal; and a training adapter detachably coupled between said bottom end plate and said base coupling means for isolating the explosion generated within said base coupling means from said bottom end plate.

2. A firing device for initiating ordnance elements and systems after a preselected time delay comprising:

electronic oscillator means of known predetermined frequency for generating a series of electrical pulses;

means coupled to said electronic oscillator means for counting said predetermined number of pulses;

a rotary single-pole-multiple-throw time delay set switch for presetting a predetermined number of said pulses corresponding to a predetermined time delay;

a setting knob assembly operatively coupled to said rotary time delay set switch whereby the position of said switch and its inherent time delay selection can be mechanically controlled by a user, said setting knob assembly comprising a circular face plate having indicia about its face corresponding to the positions of the various throw contacts of said time delay set switch and having a centrally located shaft hole bored therethrough, a shaft having a diameter smaller than that of said shaft hole and biased in such a manner that in order for a portion of said shaft to pass through said shaft hole and emerge beyond said circular plate it must be forced contrary to said bias, a setting knob pivotally coupled to said shaft in such a manner that said knob maintains the position of said shaft partially through said shaft hole contrary to said bias and such that said knob can be pivoted away from said circular plate thereby drawing said shaft even further through said shaft hole contrary to said bias, a cam coupled to said shaft, switch means capable of at least two positions disposed proximate of said cam such that when said cam moves in toward said circular disc in response to said setting knob being pivoted, said switch means assumes a first position and when said cam moves away from said circular disc in response to said bias when said shaft is released from said setting knob, said switch means assumes a second position, wherein said first switch means are electrically coupled to said counting means, and self-test indicia means electrically coupled to said counting means such that said indicia means is activated by said counting means whenever said counting means operates responsive to said first switch means position;

means coupled and responsive to said counting means for generating an electrical firing signal after said predetermined number of pulses have been counted; and a bottom end plate containing electrical terminals through which said firing signal is made available for coupling to ordnance elements and systems to initiate said ordnance elements and systems after a preselected and preset time delay.

3. The firing device of claim 2 wherein said setting knob assembly further includes holes cut in said circular disc corresponding to each of said switch contact positions and a hole cut through said knob whereby said knob, when aligned into a preselected switch position can be locked in place by passing a rod through said knob hole and into said switch plate hole.

4. The firing device of claim 3 further including a training adapter detachably coupled between said bottom end plate and said base coupling means for isolating the explosion generated within said base coupling means for said bottom end plate.

5. A training adapter for use with a firing device that produces an electrical firing signal comprising:

a generally disc shaped member having an explosive end face and a firing device end face and having a first bore extending from said explosive end and partially therethrough, and having a second smaller bore extending through the remainder of said disc member;

terminal means positioned within said second bore for electrically coupling a firing signal from, while mechanically isolating, said firing device;

a bushing located at said firing device end for coupling to said firing device; and a detonator partially within said bushing, partially within said second bore and extending into said first bore, said detonator positioned such that its explosion will be contained within said first bore, whereby an explosion electrically triggered by said firing device is isolated therefrom.

* * * * *